US009121320B2

(12) United States Patent
Carr et al.

(10) Patent No.: US 9,121,320 B2
(45) Date of Patent: Sep. 1, 2015

(54) TAILOR TO FIT MUFFLER

(71) Applicant: Tenneco Automotive Operating Company Inc., Lake Forest, IL (US)

(72) Inventors: Richard T. Carr, South Lyon, MI (US); Frederick M. Baumgartner, Homer, MI (US); David R. Bednarz, Ann Arbor, MI (US); Deep K. Singh, Canton, MI (US); Bradley B. Walworth, Jackson, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 0 days.

(21) Appl. No.: 14/462,857

(22) Filed: Aug. 19, 2014

(65) Prior Publication Data

US 2015/0053501 A1 Feb. 26, 2015

Related U.S. Application Data

(60) Provisional application No. 61/867,821, filed on Aug. 20, 2013.

(51) Int. Cl.
*F01N 1/08* (2006.01)

(52) U.S. Cl.
CPC ..... *F01N 1/086* (2013.01)

(58) Field of Classification Search
CPC ..... F01N 1/08
USPC ..... 181/268, 227, 212
See application file for complete search history.

(56) References Cited

U.S. PATENT DOCUMENTS

| | | | | | |
|---|---|---|---|---|---|
| 1,280,386 | A | * | 10/1918 | Buehner | 181/238 |
| 2,692,025 | A | * | 10/1954 | Maxim | 181/238 |
| 3,388,769 | A | * | 6/1968 | Martoia | 181/238 |
| 3,420,052 | A | * | 1/1969 | Miller | 60/320 |
| 3,794,139 | A | * | 2/1974 | Hetherington et al. | 181/238 |
| 5,265,420 | A | * | 11/1993 | Rutschmann | 60/302 |
| 8,827,035 | B2 | * | 9/2014 | Ross et al. | 181/282 |
| 2006/0231330 | A1 | | 10/2006 | Morales et al. | |
| 2007/0227807 | A1 | | 10/2007 | Meneely et al. | |
| 2008/0093161 | A1 | | 4/2008 | Winkel et al. | |
| 2009/0229913 | A1 | | 9/2009 | Tonietto et al. | |
| 2013/0213734 | A1 | * | 8/2013 | Ahn et al. | 181/256 |
| 2014/0144721 | A1 | * | 5/2014 | Park | 181/268 |
| 2014/0151149 | A1 | | 6/2014 | Ross et al. | |

FOREIGN PATENT DOCUMENTS

| | | | |
|---|---|---|---|
| EP | 0328056 | | 8/1989 |
| KR | 101262612 | * | 5/2013 |

* cited by examiner

*Primary Examiner* — Forrest M Phillips
(74) *Attorney, Agent, or Firm* — Harness, Dickey & Pierce, P.L.C.

(57) ABSTRACT

A muffler includes a shell, baffles, and a plurality of pipes. The shell defines first and second end cavities and a central cavity. The end cavities have larger cross-sectional areas that a cross-sectional area of the central cavity. The baffles cooperate to form multiple chambers within the shell. A first inlet directs a first portion of the exhaust into a first chamber. A second inlet directs a second portion of the exhaust into a second chamber. A first pipe extends through first, third and fourth baffles and includes an inlet in the fourth chamber. The first pipe directs exhaust from the fourth chamber to a first outlet at the first end cavity. A second pipe extends through the second, third and fourth baffles and includes an inlet in the third chamber. The second pipe directs exhaust from the third chamber to a second outlet at the second end cavity.

29 Claims, 11 Drawing Sheets

TAILOR TO FIT MUFFLER

CROSS-REFERENCE TO RELATED APPLICATIONS

This application claims the benefit of U.S. Provisional Application No. 61/867,821, filed on Aug. 20, 2013. The entire disclosure of the above application is incorporated herein by reference.

FIELD

The present disclosure relates to a muffler for an exhaust system for an internal combustion engine.

BACKGROUND

This section provides background information related to the present disclosure and is not necessarily prior art.

The flow of exhaust gas from an engine through one or more exhaust pipes can generate a substantial amount of noise. Mufflers have been used with exhaust systems to reduce this noise and/or tune the exhaust system so that exhaust gas flow therethrough generates a desired or range of sounds.

A single muffler can be provided to receive exhaust gas from two exhaust pipes (i.e., a dual-exhaust configuration). Tradeoffs between packaging space and performance are often made in the design of such a single-muffler, dual-exhaust system. The present disclosure provides a muffler that fits within limited space on a vehicle while providing a desired level of performance. The present disclosure also provides an efficient and cost-effective method of manufacturing such a muffler.

SUMMARY

This section provides a general summary of the disclosure, and is not a comprehensive disclosure of its full scope or all of its features.

In one form, the present disclosure provides a muffler receiving exhaust from an engine. The muffler may include a shell and first, second and third subassemblies. The one-piece shell may include a first end portion, a second end portion and a central portion disposed therebetween. The shell may include a seam that extends parallel to a longitudinal axis of the shell and terminates at a first seam end and at a second seam end that is spaced apart from the first seam end. The first and second end portions may define first and second cavities. At least one of the first and second cavities having a larger cross-sectional area than a cross-sectional area of a central cavity defined by the central portion. The cross-sectional areas of the first, second and central cavities may be defined by planes that are perpendicular to the longitudinal axis. The first subassembly may be disposed within the central portion of the shell and may include first and second pipes and a plurality of baffles. The second subassembly may be disposed within the first end portion of the shell and may include a first outlet pipe fluidly connected with the first pipe of the first subassembly. The third subassembly may be disposed within the second end portion of the shell and may include a second outlet pipe fluidly connected with the second pipe of the first subassembly.

In some embodiments, the muffler includes first and second end caps attached to the first and second end portions and enclosing the first, second and central cavities.

In some embodiments, the muffler includes first and second bushings extending through the shell and fixedly engaging the first and second outlet pipes.

In some embodiments, the first and second bushings directly engage the shell and the first and second outlet pipes.

In some embodiments, the second and third subassemblies include first and second inlet pipes that extend through the shell.

In some embodiments, the muffler includes bushings extending through the shell and fixedly engaging the first and second outlet pipes and the first and second inlet pipes.

In some embodiments, the first and second end portions have oval-shaped cross sections.

In some embodiments, the baffles extend parallel to each other and perpendicular to the longitudinal axis.

In another form, the present disclosure provides a muffler that may include a tubular shell, a plurality of baffles, first and second inlet pipes and first and second elongated pipes. The tubular shell may define first and second end cavities and a central cavity disposed therebetween. The first and second end cavities may have larger cross-sectional areas that a cross-sectional area of the central cavity. The cross-sectional areas of the cavities are defined by planes that are perpendicular to a longitudinal axis of the tubular shell. A first baffle may be disposed in the first end cavity and may define a first chamber therein. The first baffle may separate the first chamber and the central cavity and may include apertures allowing fluid communication between the first chamber and the central cavity. A second baffle may be disposed in the second end cavity and may define a second chamber therein. The second baffle may separate the second chamber and the central cavity and may include apertures allowing fluid communication between the second chamber and the central cavity. A third baffle may be disposed in the central cavity and may cooperate with the first baffle to define a third chamber therebetween. A fourth baffle may be disposed in the central cavity and may cooperate with the second baffle to define a fourth chamber therebetween. The first inlet pipe may direct a first portion of the exhaust gas into the first chamber. The second inlet pipe may direct a second portion of the exhaust gas into the second chamber. The first elongated pipe may extend through the first, third and fourth baffles and may include an inlet in the fourth chamber. The first elongated pipe may direct exhaust gas from the fourth chamber to a first outlet extending through the shell at the first end cavity. The second elongated pipe may extend through the second, third and fourth baffles and may include an inlet in the third chamber. The second elongated pipe may direct exhaust gas from the third chamber to a second outlet extending through the shell at the second end cavity.

In some embodiments, the muffler includes a fifth baffle disposed in the central cavity between the third and fourth baffles. The third and fifth baffles may define a fifth chamber therebetween. The fourth and fifth baffles may define a sixth chamber therebetween.

In some embodiments, the muffler includes a sixth baffle disposed in the first end cavity and cooperating with the first baffle to define the first chamber.

In some embodiments, the muffler includes a seventh baffle disposed in the second end cavity and cooperating with the second baffle to define the second chamber.

In some embodiments, the muffler includes first and second end caps attached to respective axial ends of the shell. The first end cap may cooperate with the sixth baffle to define a seventh chamber therebetween. The second end cap may cooperate with the seventh baffle to define an eighth chamber therebetween.

In some embodiments, the shell is a one-piece shell including a seam that extends parallel to the longitudinal axis of the shell and terminates at a first seam end and at a second seam end that is spaced apart from the first seam end.

In some embodiments, the first and second end cavities have oval-shaped cross sections.

In some embodiments, the muffler includes bushings extending through the shell and fixedly engaging the first and second inlet pipes and the first and second outlets.

In some embodiments, the cross-sectional area of one of the first and second end cavities is larger than the cross-sectional area of the other of the first and second cavities.

In some embodiments, a cross-sectional shape of one of the first and second end cavities is different than a cross-sectional shape of the other of the first and second cavities.

In another form, the present disclosure provides a method of manufacturing a muffler for an exhaust system of an internal combustion engine. The method may include providing a flat, one-piece sheet metal blank having first and second opposing edge portions. The blank may be formed into a tubular shell by bending the blank so that the first and second edge portions face each other and fixing the first and second edge portions in abutting contact with each other. In some embodiments, the tubular shell may be formed from only one sheet metal blank. The tubular shell may define a central cavity and first and second end cavities. The first and second end cavities may have larger cross-sectional areas than a cross-sectional area of the central cavity. A first subassembly may be inserted through a first axial end of the tubular shell. The first subassembly may be positioned in the central cavity and may include first and second pipes and a plurality of baffles. A second subassembly may be inserted into the first axial end of the tubular shell. The second subassembly may be fixed in the first end cavity such that a first outlet pipe of the second subassembly is fluidly connected with the first pipe of the first subassembly. A third subassembly may be inserted into a second axial end of the tubular shell. The third subassembly may be fixed in the second end cavity such that a second outlet pipe of the second subassembly is fluidly connected with the second pipe of the first subassembly.

In some embodiments, the method includes inserting a first bushing into a first outlet formed in the tubular shell and into the first outlet pipe.

In some embodiments, the method includes expanding the first bushing with an expansion tool to increase an outer diameter of the first bushing to fixedly couple the bushing to the outlet and the first outlet pipe.

In some embodiments, the third subassembly is inserted into the tubular shell before the first and second subassemblies are inserted into the tubular shell.

In some embodiments, the third subassembly is inserted into the tubular shell after the first and second subassemblies are inserted into the tubular shell.

In some embodiments, the second subassembly includes a first inlet pipe and a first valve assembly configured to control fluid flow through the first inlet pipe. The third subassembly may include a second inlet pipe and a second valve assembly configured to control fluid flow through the second inlet pipe.

In some embodiments, the method includes inserting bushings into each of the first and second inlet pipes and the first and second outlet pipes and expanding the bushings with an expansion tool to increase outer diameters of the bushings to fixedly couple the bushings to the first and second inlet pipes and the first and second outlet pipes.

In some embodiments, the step of fixing the first and second edge portions of the tubular shell in abutting contact with each other includes welding the first and second edge portions together.

In some embodiments, the method includes fixing first and second end caps to the first and second axial ends of the tubular shell.

In some embodiments, the flat, one-piece sheet metal blank includes a dog-bone shape prior to the blank being formed into the tubular shell.

In some embodiments, the method includes forming a plurality of elongated ridges in the tubular shell. The ridges may extend longitudinally parallel to the longitudinal axis and may be received in notches formed in the plurality of baffles.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
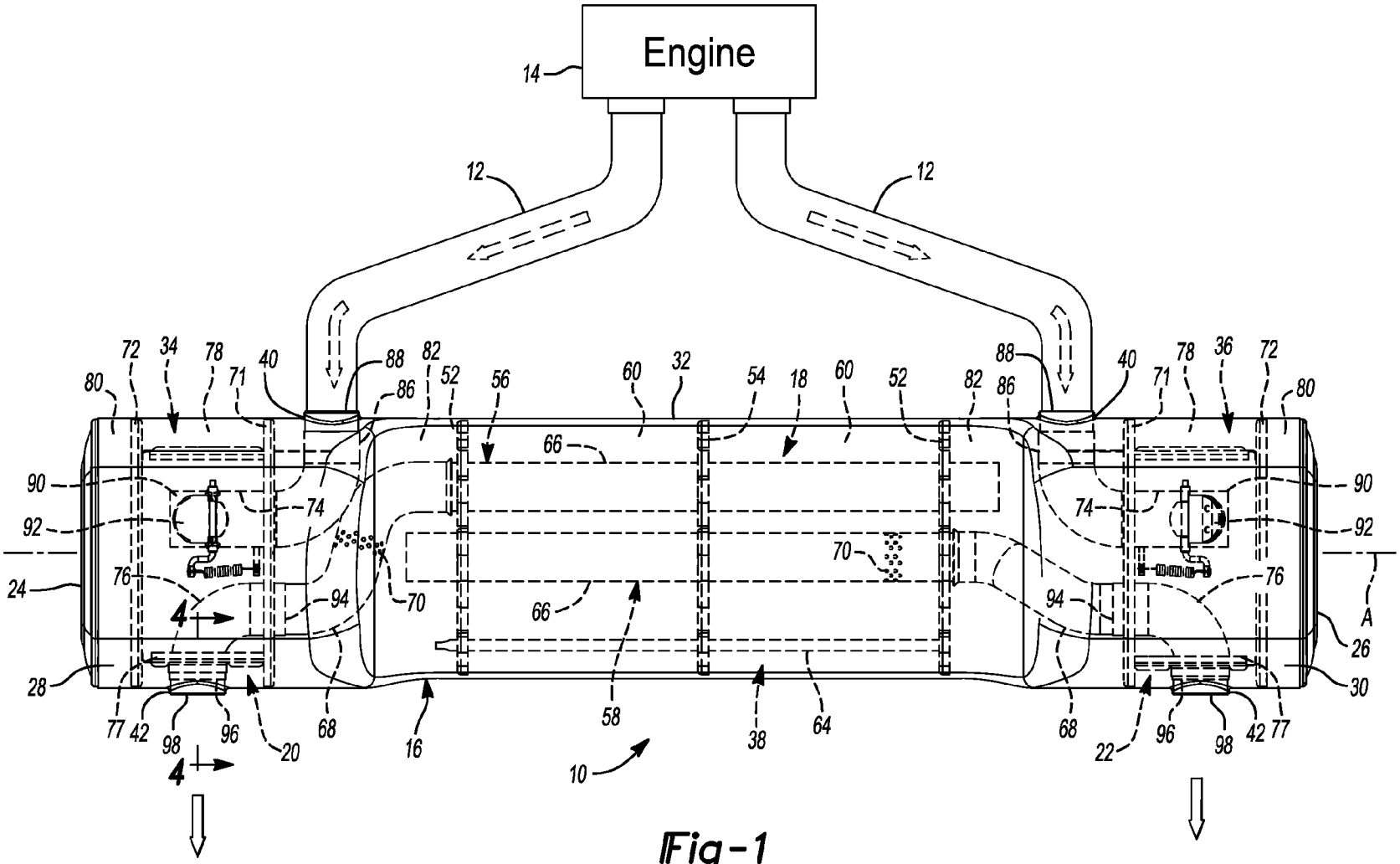
FIG. 1 is a plan view of a muffler fluidly coupled with an exhaust system and engine.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-14, an exemplary muffler 10 is provided that may receive exhaust gas from a pair of exhaust pipes 12 (shown schematically in FIG. 1) connected to an engine 14 (shown schematically in FIG. 1). The muffler 10 may be shaped to fit within a given available space on a vehicle (not shown). For example, the muffler 10 may be shaped to fit around a spare tire well of the vehicle and/or other components at or near an undercarriage of the vehicle.

The muffler 10 may include a shell 16, a first cartridge or subassembly 18, a second cartridge or subassembly 20 and a third cartridge or subassembly 22. The subassemblies 18, 20, 22 are disposed within the shell 16. First and second end caps 24, 26 are fixed to axial ends of the shell 16 to enclose the subassemblies 18, 20, 22 within the shell 16.

Figure 2:
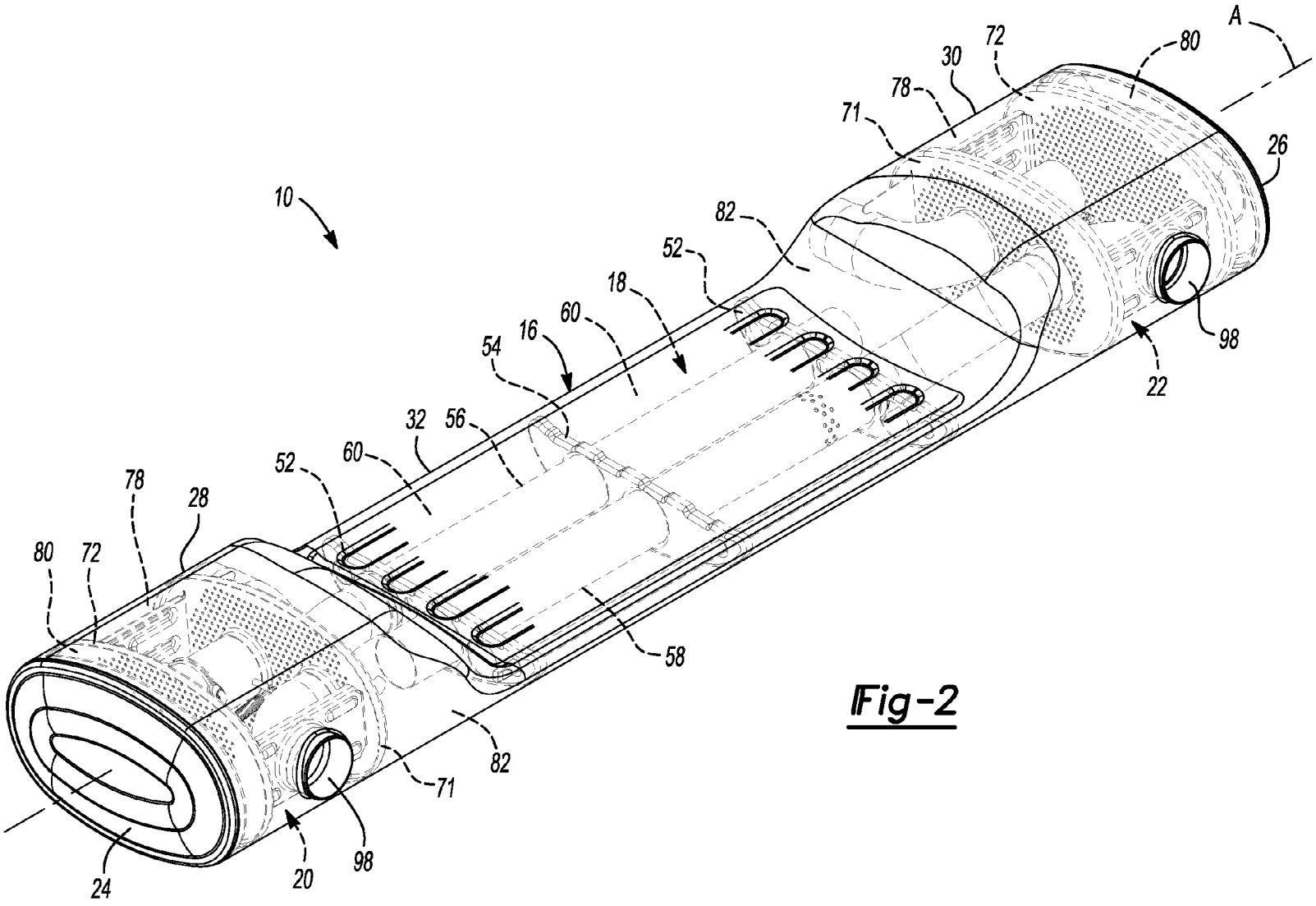
FIG. 2 is a perspective view of the muffler.
Figure 3:
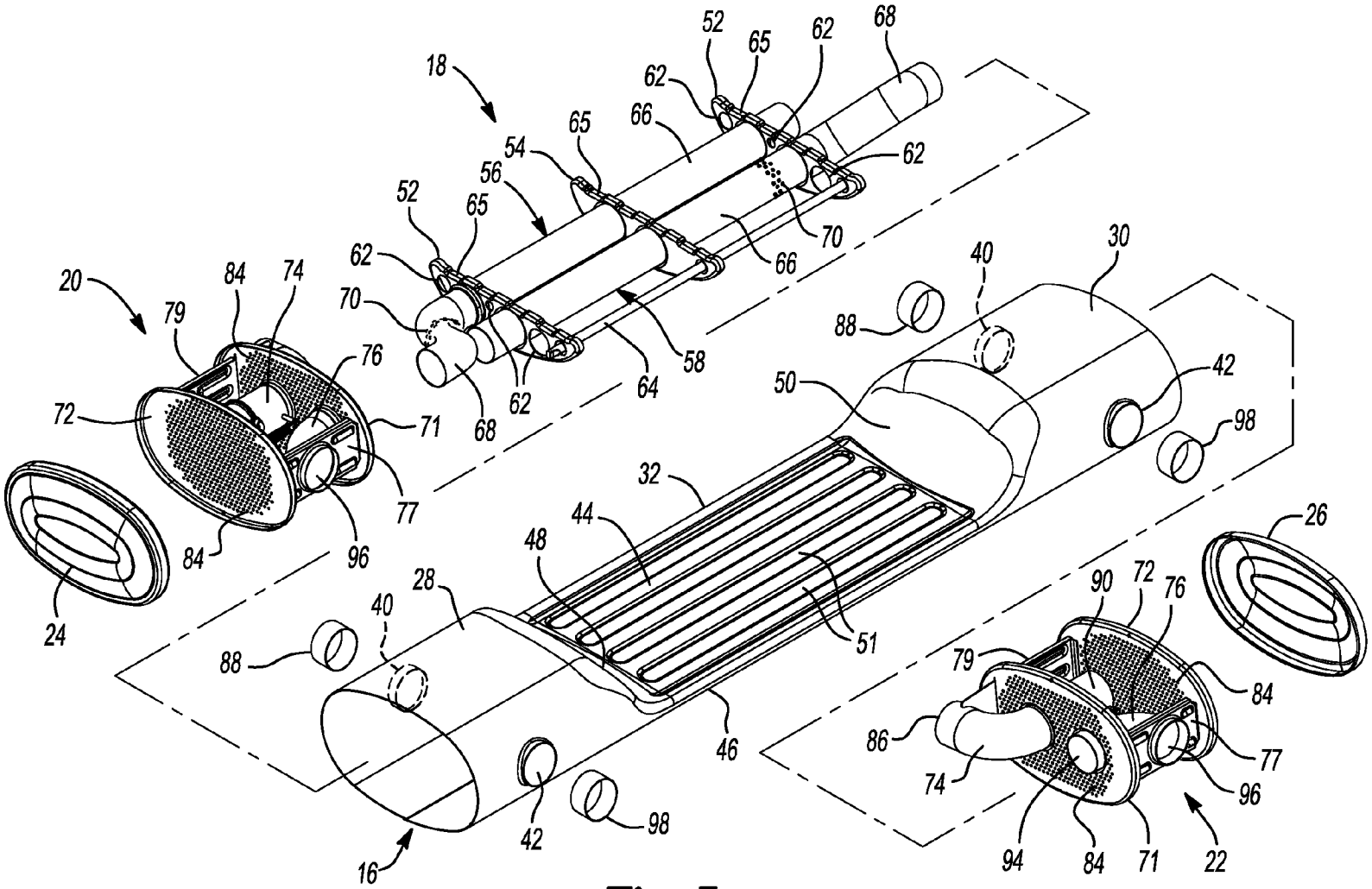
FIG. 3 is an exploded perspective view of the muffler.
Figure 8:
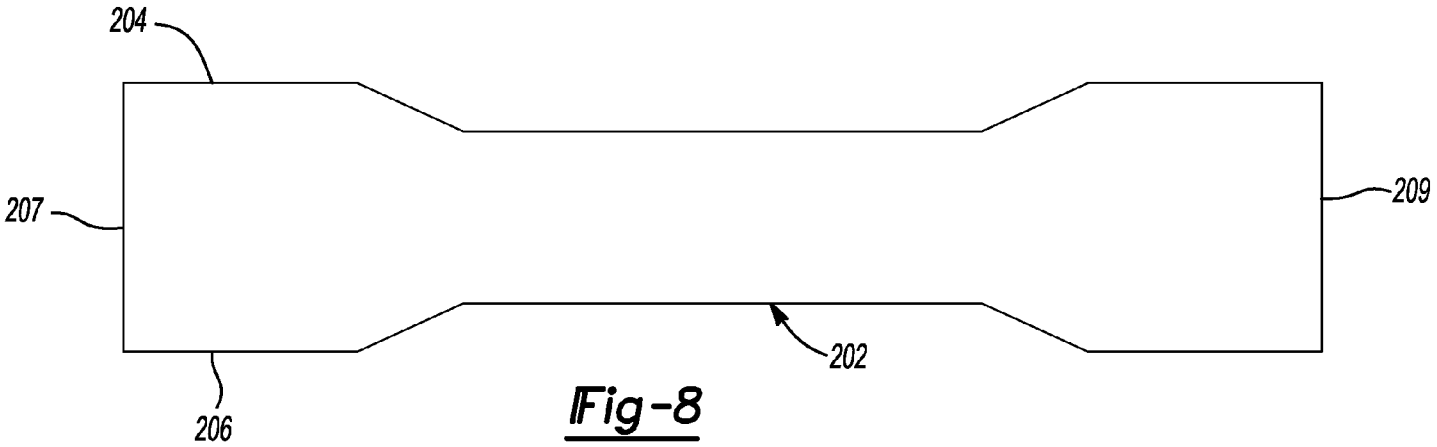
FIG. 8 is a plan view of a blank from which a shell of the muffler is formed.

The shell 16 may be generally tubular member formed from a single, one-piece sheet metal blank 202 (FIG. 8). The shell 16 may include first and second outer portions 28, 30 and a recessed central portion 32. A longitudinal axis A (FIG. 2) of the shell 16 may extend through the first and second outer portions 28, 30. The first and second outer portions 28, 30 define first and second outer cavities 34, 36, respectively. The central portion 32 defines a central cavity 38 disposed between and in communication with the outer cavities 34, 36. As shown in FIGS. 2 and 3, a thickness of the central portion 32 is less than the thicknesses of the first and second outer portions 28, 30. In other words, the cross-sectional areas of the first and second outer cavities 34, 36 (i.e., cross-sectional areas of planes of the first and second outer cavities 34, 36 that are perpendicular to the longitudinal axis A and through which the longitudinal axis A extends) are larger than the cross-sectional area of the central cavity 38 (i.e., a cross-sectional area of a plane of the central cavity 38 that is perpendicular to the longitudinal axis A and through which the longitudinal axis A extends).

The outer cavities 34, 36 may have generally oval-shaped cross section. The central cavity 38 may have a truncated oval-shaped cross section. While the first and second outer portions 28, 30 are shown in FIGS. 2 and 3 as being substantially exact mirror images of each other, in some embodiments, one of the outer portions 28, 30 may be larger than and/or shaped differently than the other of the outer portions 28, 30.

Each of the first and second outer portions 28, 30 may include an inlet opening 40 and an outlet opening 42. The inlet and outlet openings 40, 42 are in communication with the cavities 34, 36, 38. The central portion 32 may include a relatively flat first side 44 and a curved second side 46 opposite the first side 44. First and second sloped surfaces 48, 50 extend between the first side 44 of the central portion 32 to the first and second outer portions 28, 30, respectively. An exterior surface of the first side 44 may include a plurality of grooves 51 formed therein. The grooves 51 form ridges on the interior surface of the first side 44. The second side 46 may have the same or similar shape as the outer portions 28, 30.

The first cartridge or subassembly 18 may be received in the central cavity 38 and may include a pair of outer baffles 52, a central baffle 54, a first elongated pipe 56 and a second elongated pipe 58. The central baffle 54 is disposed between the outer baffles 52. The baffles 52, 54 are arranged perpendicular to the longitudinal axis A and have shapes that substantially match the cross-sectional shape of the central cavity 38. In this manner, the outer baffles 52 cooperate with the central baffle 54 to define a pair of chambers 60. In some configurations, the central baffle 54 sealingly separates the chambers 60 from each other to prevent fluid communication therebetween. In other configurations, the chambers 60 are allowed to fluidly communicate with each other. The outer baffles 54 may include apertures 62 through which fluid and/or sound waves may move into and out of the chambers 60. A support rod 64 may extend through the baffles 52, 54 to provide rigidity and to reinforce the first subassembly 18. The baffles 54, 54 may include notches 65 that receive the ridges (i.e., the interior sides of the grooves 50) of the shell 16.

The first and second elongated pipes 56, 58 extend through and are supported by the baffles 52, 54. Each of the first and second elongated pipes 56, 58 may include a substantially straight portion 66 and a generally S-shaped or serpentine end portion 68. One or both of the straight or serpentine portions 66, 68 of each pipe 56, 58 may include a plurality of venting apertures 70 through which fluid and/or sound waves may move into or out of the pipes 56, 58.

The second and third cartridges or subassemblies 20, 22 may be received in the first and second outer cavities 34, 36, respectively. The second and third subassemblies 20, 22 can be similar or identical to each other. Each of the second and third subassemblies 20, 22 may include an inner baffle 71, an outer baffle 72, an inlet pipe 74 and an outlet pipe 76.

The baffles 71, 72 may be spaced apart from each other and parallel to each other to form chambers 78 therebetween. Support members 77, 79 extend between and engage the baffles 71, 72 to securely fix the baffles 71, 72 relative to each other. The outer baffle 72 of the second subassembly 20 may cooperate with the first end cap 24 to form an outer chamber 80 therebetween. The outer baffle 72 of the third subassembly 22 may cooperate with the second end cap 26 to form another outer chamber 80 therebetween. The inner baffles 71 of the second and third subassemblies 20, 22 may cooperate with the outer baffles 52 of the first subassembly 18 to form additional chambers 82 therebetween. The baffles 71, 72 of the second and third subassemblies 20, 22 may include apertures 84 through which fluid and/or sound waves can move into and out of the chambers 78 to and from the chambers 80, 82.

The inlet pipes 74 may extend through the chambers 82 (between corresponding baffles 52, 71) and through the corresponding inner baffles 71. First ends 86 of the inlet pipes 74 may be coupled to a corresponding one of the exhaust pipes 12 (FIG. 1) by bushings 88 that extend through the shell 16. A second end 90 of each inlet pipe 74 may be disposed in the corresponding chamber 78 (between baffles 71, 72). Valves 92 may be disposed within the inlet pipes 74 to vary the resistance to exhaust gas flow from the exhaust pipes 12 through the inlet pipes 74 and into the chambers 78. Valves 92 include a rotatable flap biased toward a closed position. Restricted flow through the valve occurs when the valve flap is in the closed position. As exhaust gas pressure increases, the valve flap rotates to the open position and restriction to exhaust gas flow is minimized.

The outlet pipe 76 of the second subassembly 20 may extend through the inner baffle 71 of the second subassembly 20 and may be fluidly coupled at a first end 94 to the serpentine portion 68 of the first elongated pipe 56 of the first subassembly 18. The outlet pipe 76 of the third subassembly 22 may extend through the inner baffle 71 of the third subassembly 22 and may be fluidly coupled at the first end 94 to the serpentine portion 68 of the second elongated pipe 58 of the first subassembly 18. Second ends 96 of the outlet pipes 76 may be disposed in the chambers 78 and extend through the support members 77 and engage bushings 98 that extend through the shell 16. Therefore, exhaust gas in the chamber 82 adjacent the third subassembly 22 may flow through the first elongated pipe 56 and exit the muffler 10 through the outlet pipe 76 of the second subassembly 20. Similarly, exhaust gas in the chamber 82 adjacent the second subassembly 20 may flow through the second elongated pipe 58 and exit the muffler 10 through the outlet pipe 76 of the third subassembly 22. While not shown in the figures, tailpipes may be coupled to the bushings 98. Exhaust gas may flow from the muffler 10, through the tailpipes and into the ambient environment.

With reference to FIGS. 7-14, a method 200 of manufacturing the muffler 10 will be described. As described above, the shell 16 of the muffler 10 may be formed from a single, one-piece sheet metal blank 202 (FIG. 8). As shown in FIG. 8, in a flat condition, the blank 202 may have a generally dog-bone shape (i.e., a shape with a relatively narrow and elongated central portion and flared end portions) and includes first and second opposing lateral edge portions 204, 206. In other embodiments, the blank 202 can be generally rectangular or have any other desired shape.

Figure 7:
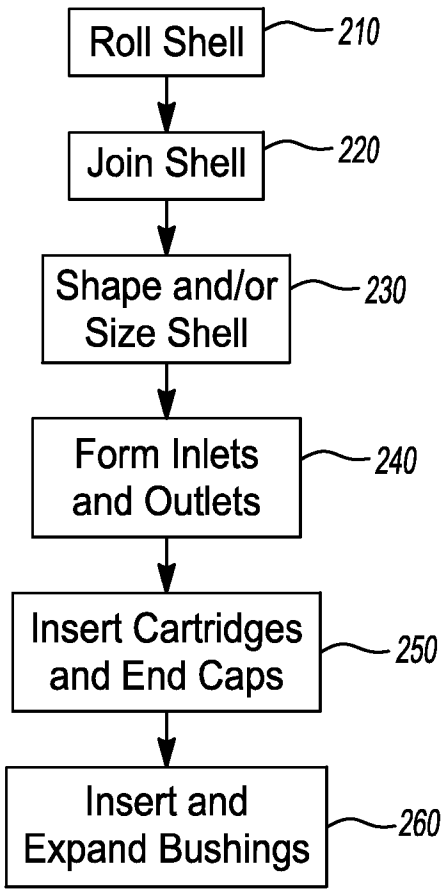
FIG. 7 is a flowchart of a method of manufacturing the muffler.
Figure 6:
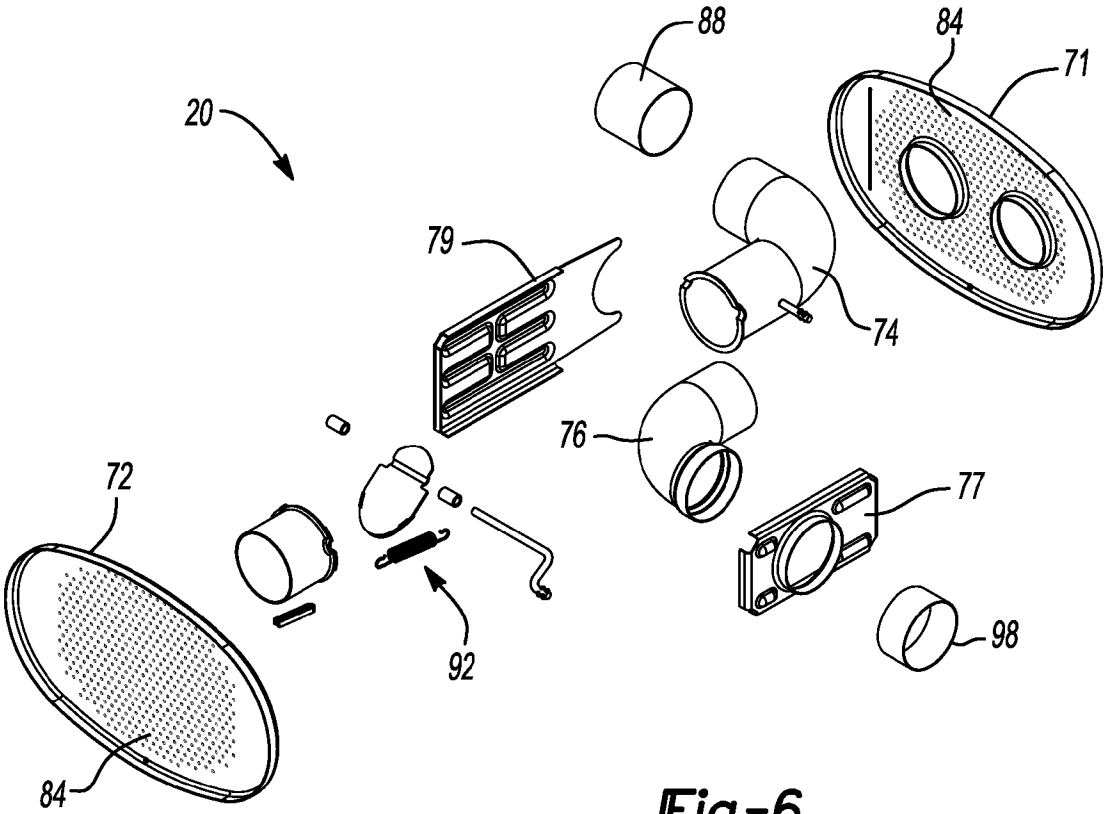
FIG. 6 is an exploded view of another cartridge or subassembly of the muffler.
Figure 9:
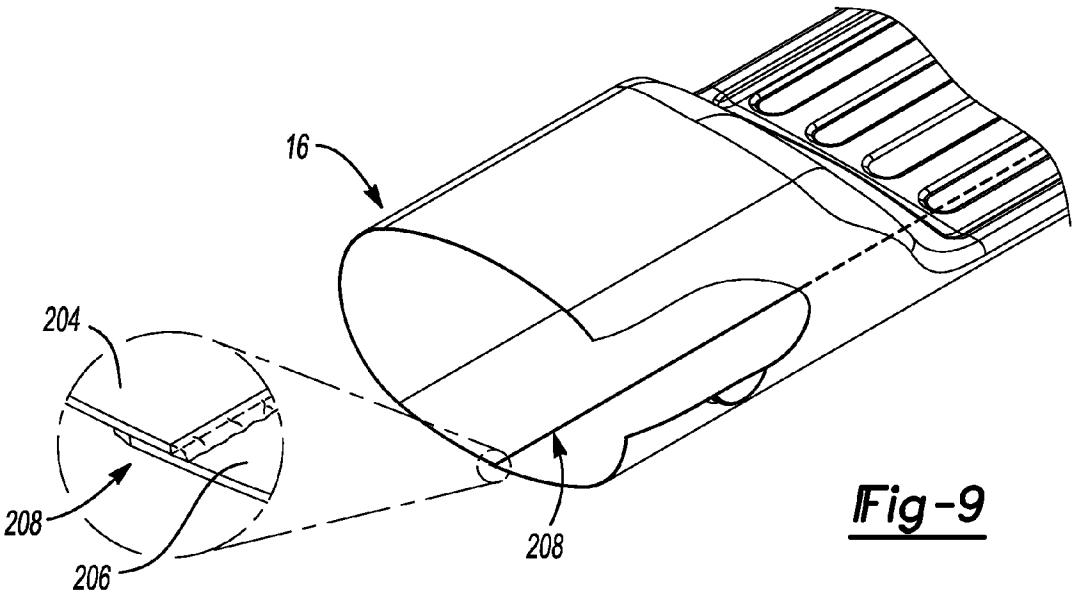
FIG. 9 is an end view of the blank in a rolled and welded condition.

As shown in FIG. 7, at step 210 of the method 200, the blank 202 may be rolled into the generally tubular shape of the shell 16. That is, the blank 202 is rolled so that the first and second edge portions 204, 206 of the blank 202 face each other. At step 220, the first and second edge portions 204, 206 are placed in abutting contact with each other (as shown in FIG. 9) to form a single seam 208 that extends parallel to the longitudinal axis A and extends from one axial end 207 of the shell 16 to the other axial end 209. The edges 204, 206 may be welded and/or otherwise suitably joined together. At step 230, the shell 16 may be spun, stamped, coined and/or otherwise shaped and/or sized to include the various contours, shapes and/or features shown in the figures and/or described above. At step 240, the inlet openings 40 and the outlet openings 42 of the shell 16 may be extruded or otherwise formed.

Forming the shell 16 from a single, one-piece blank reduces manufacturing costs relative to a shell design including first and second shell halves that are welded together. Furthermore, the one-piece shell 16 of the present disclosure may be lighter weight than a shell design including first and second shell halves that are welded together. This is because the first and second welded shell halves need to have mating flanges to sealingly fix the shell halves to each other.

Figure 10:
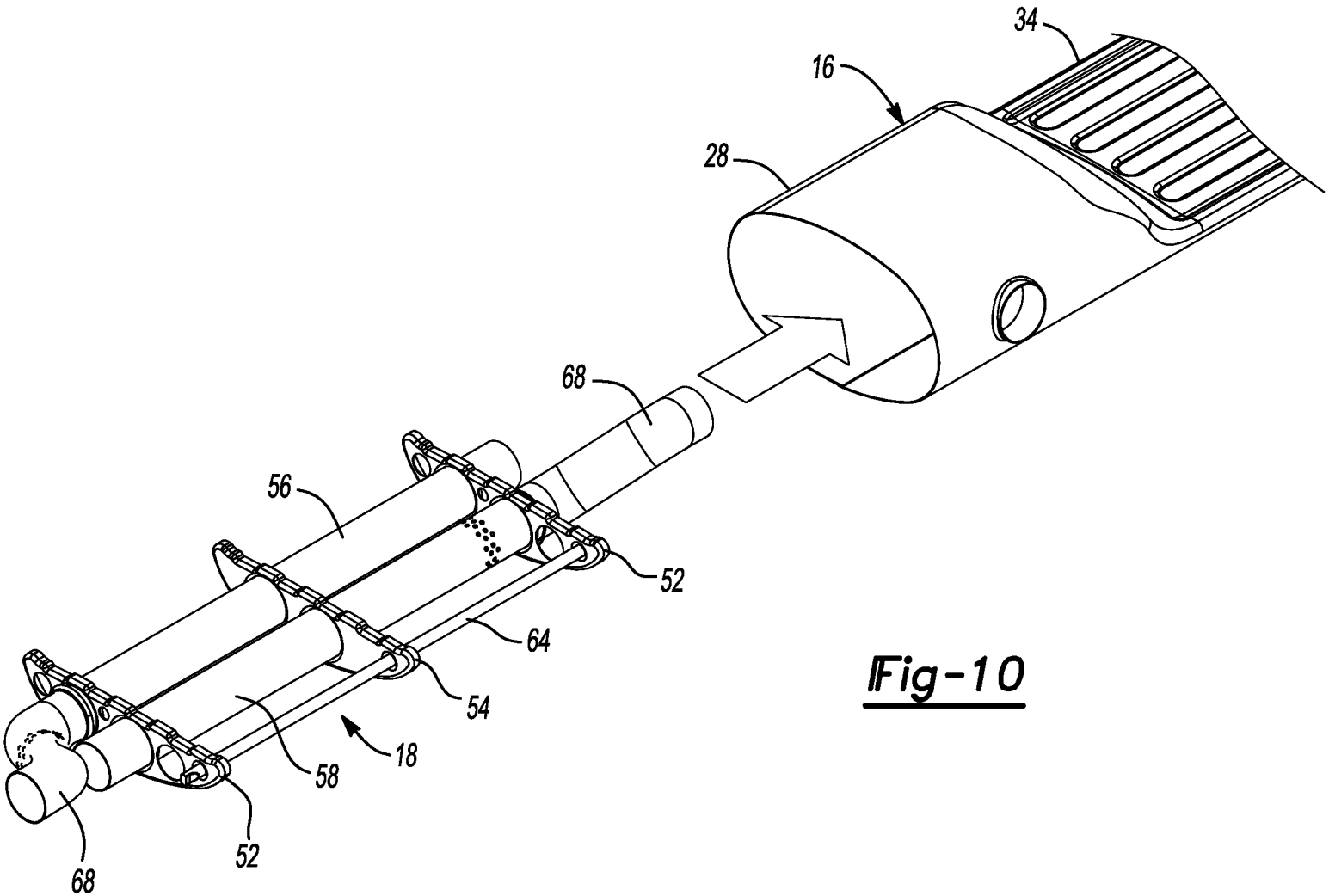
FIG. 10 is a perspective view of the first subassembly being inserted into a shell of the muffler.

At step 250, the first, second and third subassemblies 18, 20, 22 may be inserted into the shell 16. As shown in FIG. 10, the first subassembly 18 may be inserted into the central cavity 38 through the first or second outer cavity 34, 36. The baffles 52, 54 of the first subassembly 18 may be pressed into engagement with the central portion 32 of the shell 16. Additionally or alternatively, the central portion 32 of the shell 16 may be crimped and/or otherwise deformed to fixedly secure baffles 52, 54 (and the rest of the first subassembly 18) within the central cavity 38. Additionally or alternatively, the baffles 52, 54 may be welded or otherwise fixed to an interior surface of the shell 16. In some embodiments, the first subassembly 18 is not fixed directly to the shell, but instead is fixed relative to the shell 16 by its connection to the second and third subassemblies 20, 22.

Figure 11:
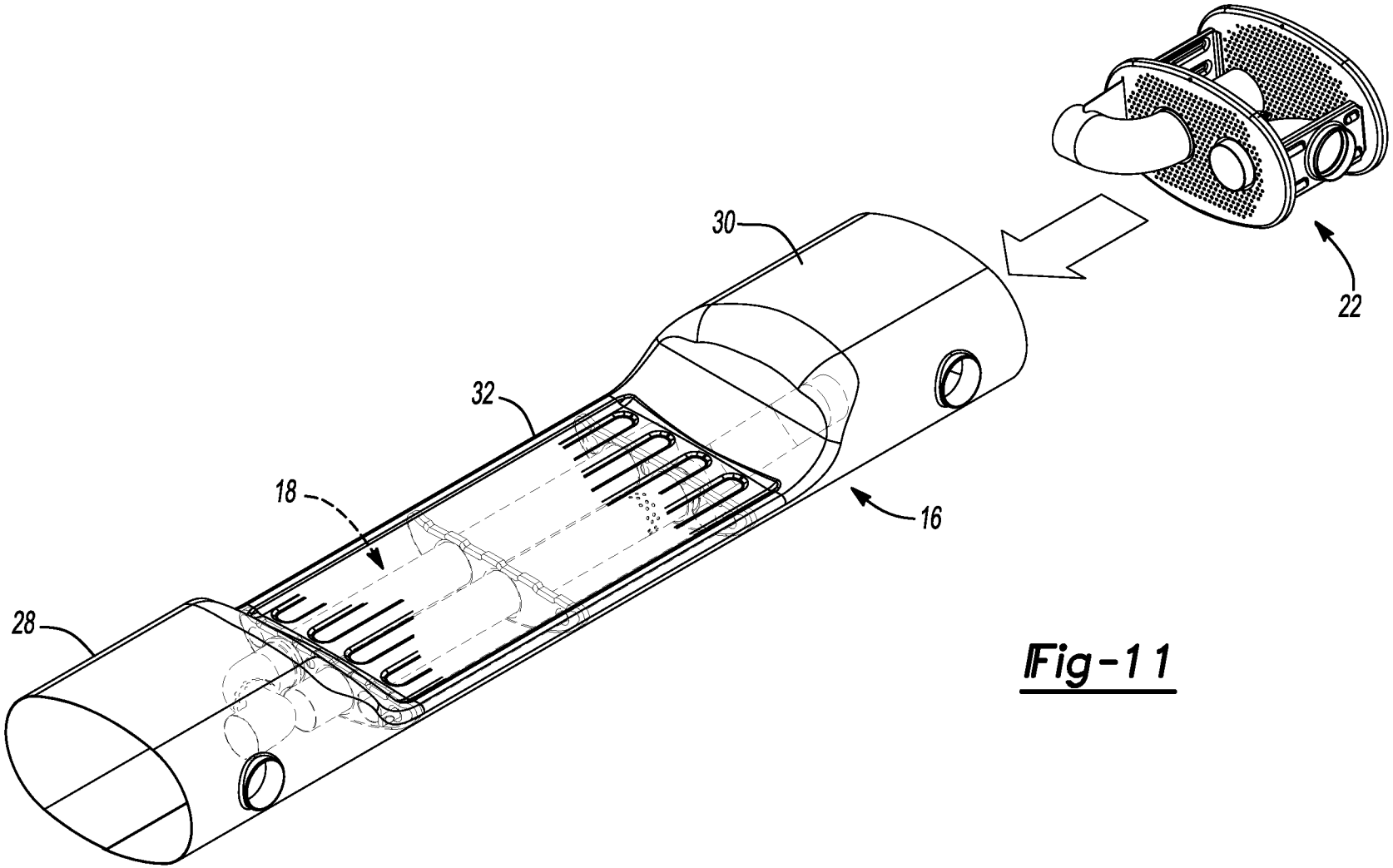
FIG. 11 is a perspective view of another subassembly being inserted into the shell of the muffler.
Figure 12:
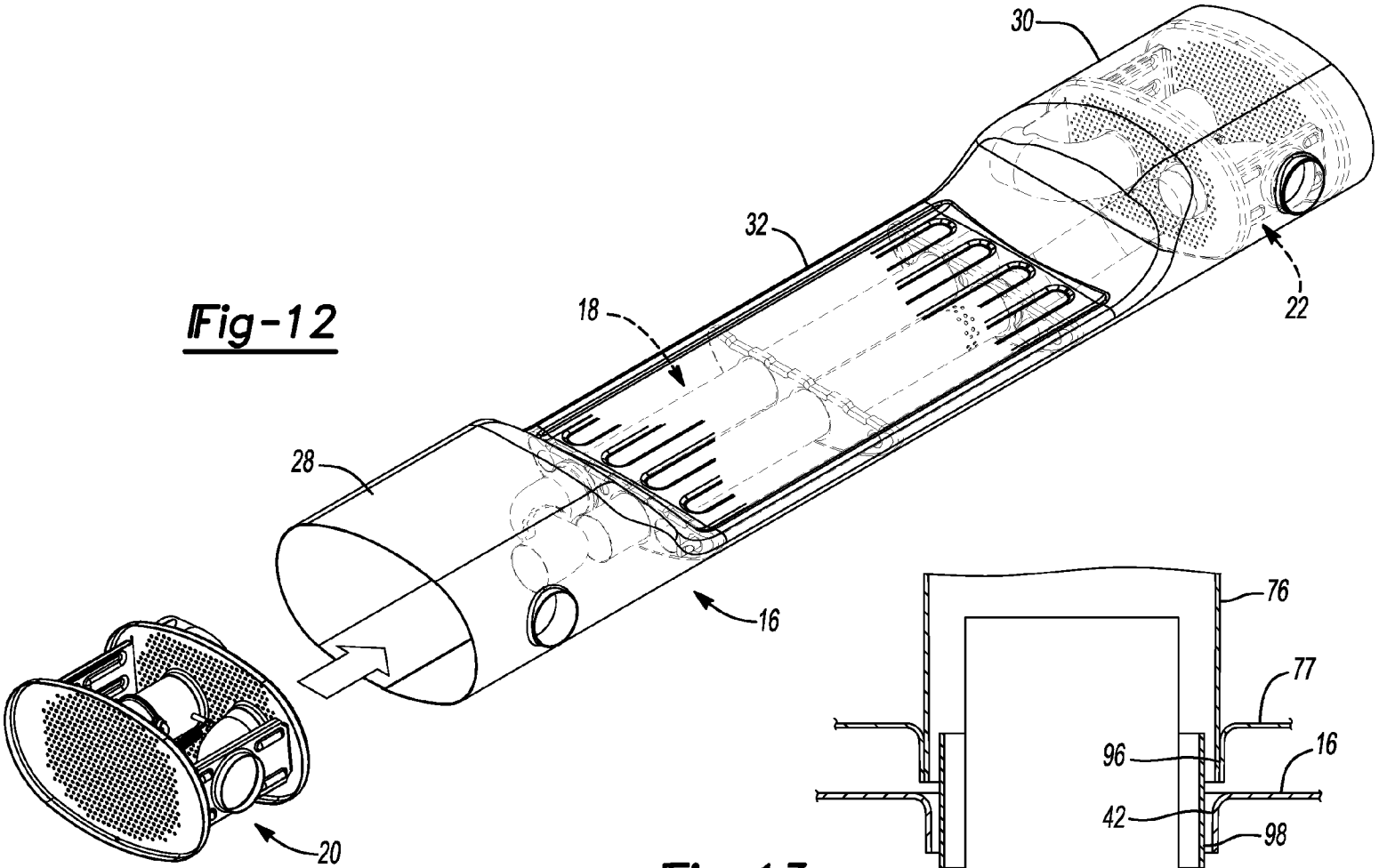
FIG. 12 is a perspective view of another subassembly being inserted into the shell of the muffler.
Figure 13:
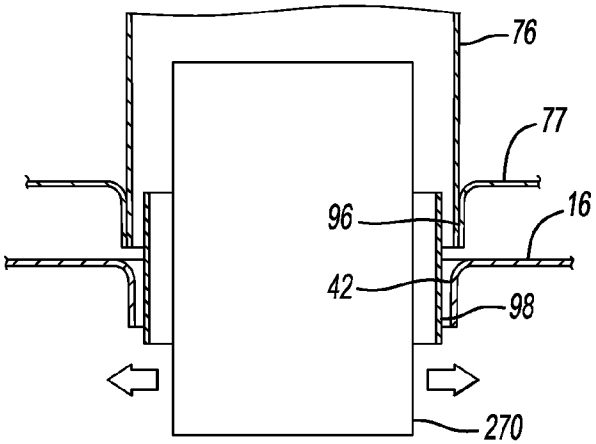
FIG. 13 is a cross-sectional view of an expansion tool expanding a bushing to fix the bushing to the muffler.
Figure 14:
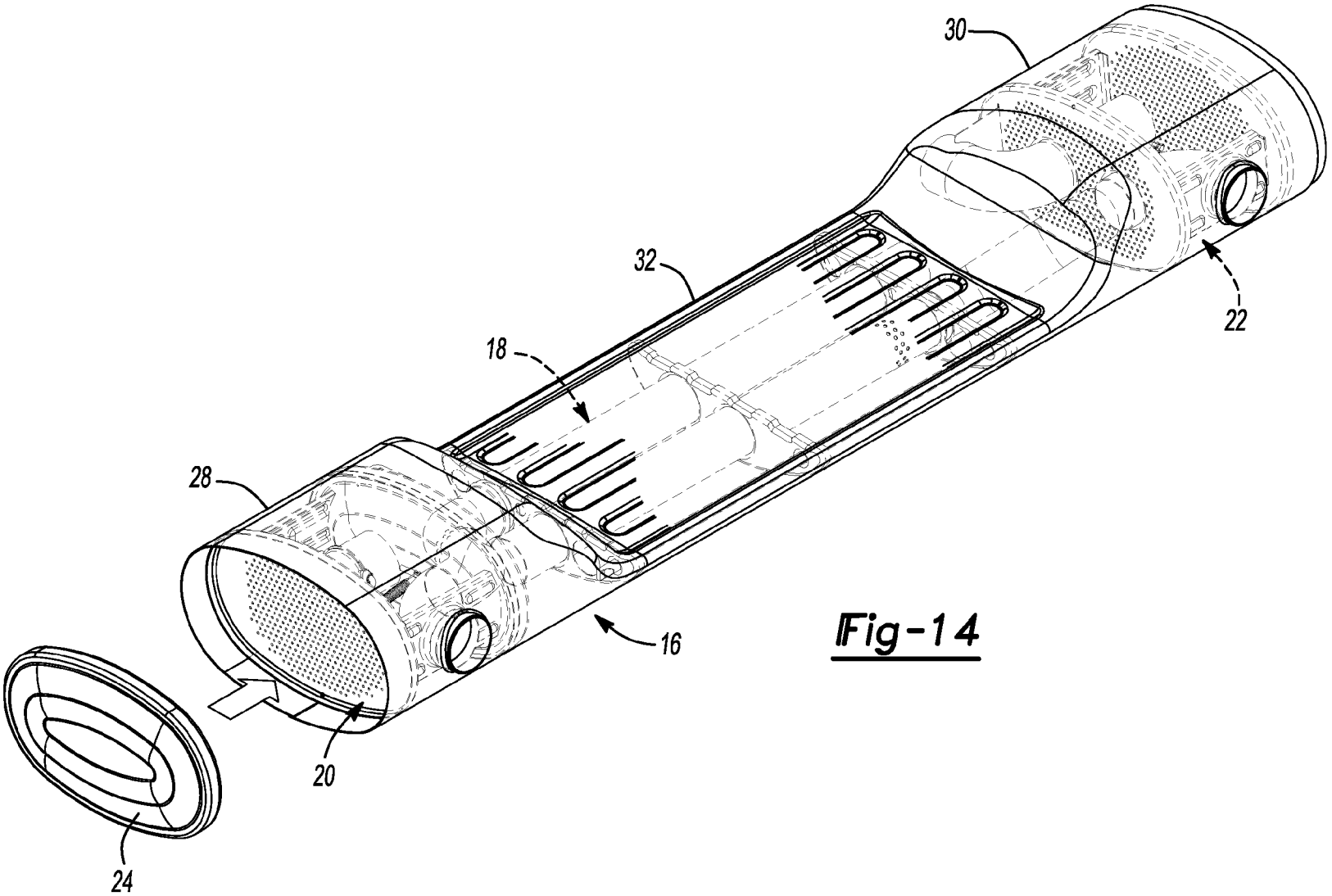
FIG. 14 is a perspective view of an end cap being installed onto the muffler.

As shown in FIGS. 11 and 12, the second and third subassemblies 20, 22 can be inserted into the first and second outer cavities 34, 36 of the shell 16, respectively, such that the outlet pipes 76 of the second and third subassemblies 20, 22 are coupled to the first and second elongated pipes 56, 58 of the first subassembly 18, respectively, as described above. Peripheries of the baffles 71, 72 may fixedly engage the inner surfaces of the first and second outer portions 28, 30 (via welding, press fit, interference fit, etc.). It will be appreciated that the first subassembly 18 could be inserted into the shell 16 prior to inserting the second and third subassemblies 20, 22 or one of the second and third subassemblies 20, 22 could be inserted into the shell 16 prior to inserting the first subassembly 18 into the shell 16. After the subassemblies 18, 20, 22 are received inside of the shell 16, the end caps 24, 26 may be secured to the shell 16 at step 250. The end caps 24, 26 can be welded or otherwise fixed onto the axial ends of the shell 16 to sealingly enclose the subassemblies 18, 20, 22 within the shell 16.

Figure 4:
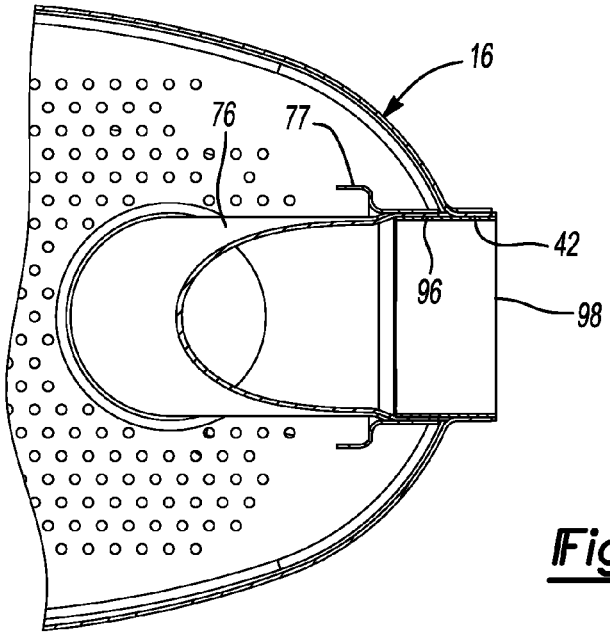
FIG. 4 is a cross-sectional view of the muffler taken along line 4-4 of FIG. 1.
Figure 5:
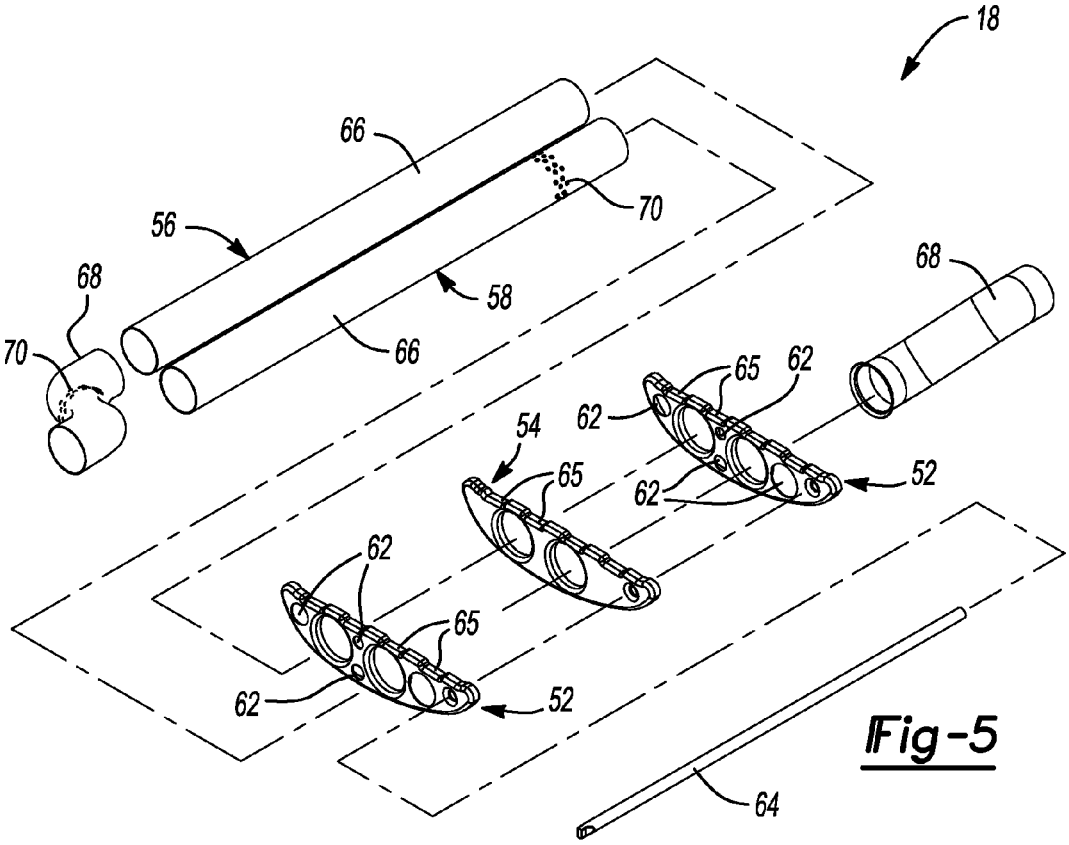
FIG. 5 is an exploded view of a first cartridge or subassembly of the muffler.

When the second and third subassemblies 20, 22 are positioned within the first and second outer cavities 34, 36 of the shell 16, the first ends 86 of the inlet pipes 74 may be substantially concentrically aligned with the inlet openings 40 of the shell 16, and the second ends 96 of the outlet pipes 76 may be substantially concentrically aligned with the outlet openings 42 of the shell 16. At step 260, the bushings 88 may be inserted into the first ends 86 of the inlet pipes 74 and the bushings 98 may be inserted in the second ends 96 of the outlet pipes 76. An expansion mandrel 270 (shown schematically in FIG. 13) or any other suitable expansion tool may be inserted into the bushings 88, 98. The expansion mandrel 270 may expand the bushings 88, 98 radially outward to fixedly secure the bushings 88, 98 to the inlet and outlet pipes 74, 76 and the shell 16. As shown in FIG. 4, when the bushings 98 are in an expanded condition (i.e., after being expanded by the expansion mandrel 270 at step 260), interference between the bushings 98, the shell 16 and the second ends 96 of the outlet pipes 76 forms a secure and fluid-tight connection.

Figure 15:
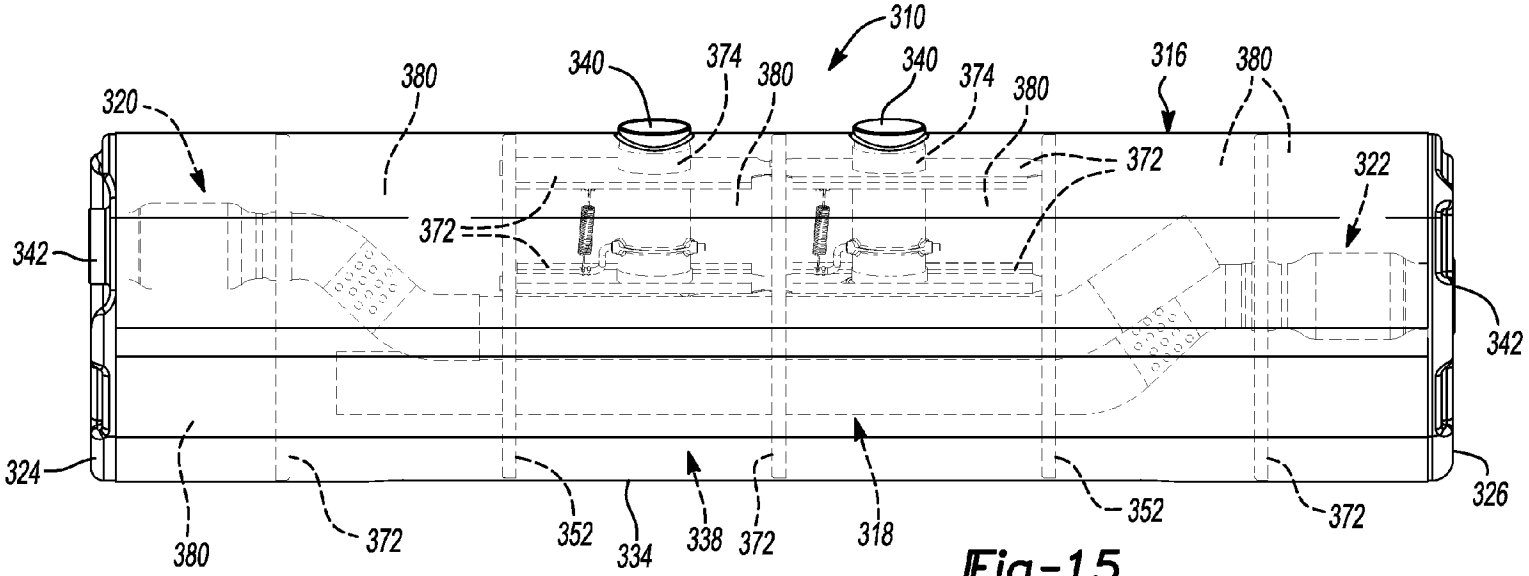
FIG. 15 is a plan view of another muffler.

With reference to FIG. 15, another muffler 310 is provided. The structure and function of the muffler 310 may be similar or identical to that of the muffler 10 described above, apart from any exceptions described below and/or shown in the figures. Therefore, similar features will not be described again in detail. The muffler 310 can be manufactured in the same or similar manner as the muffler 10.

Like the muffler 10, the muffler 310 can include a shell 316 and first second and third cartridges or subassemblies 318, 320, 322. The first subassembly 318 may be received in a central cavity 338 of the shell 316. Inlet pipes 374 may be a part of the first subassembly 318 and may be disposed between outer baffles 352 of the first subassembly 318. The inlet pipes 374 may be coupled with inlet openings 340 in a central portion 334 of the shell 316. The second and third subassemblies 320, 322 may include outlet pipes 376 that are coupled with outlet openings 342 formed in end caps 324, 326 fixed to the axial ends of the shell 316. The subassemblies 318, 320, 322 include a plurality of additional baffles 372 that cooperate to form a plurality of chambers 380 within the shell 316. The chambers 380 may be in fluid communication with each other and/or the pipes 374, 376.

Figure 16:
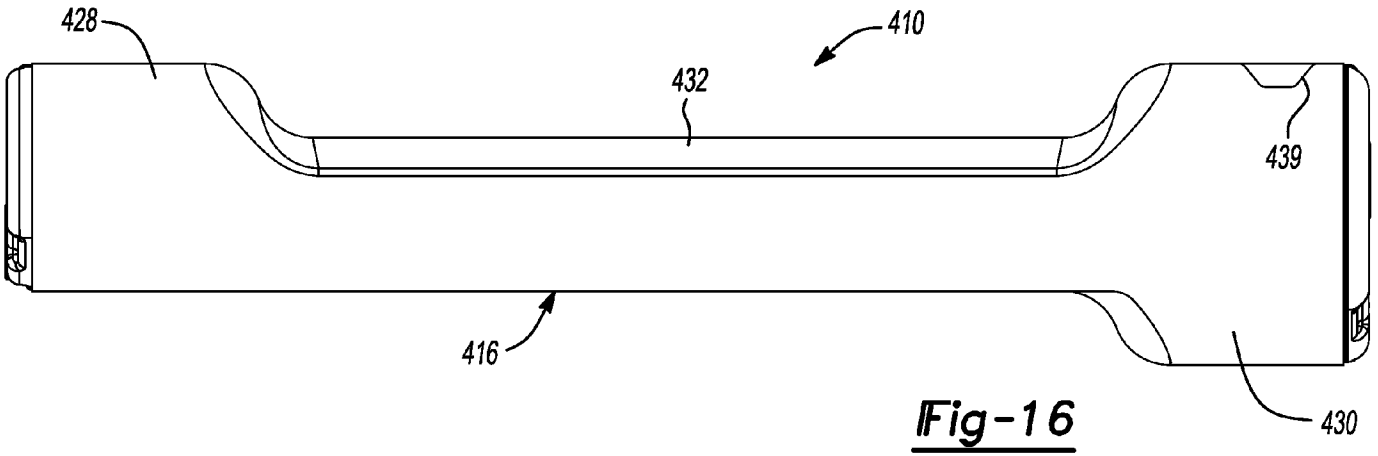
FIG. 16 is a side view of yet another muffler.

With reference to FIG. 16, another muffler 410 is provided. The structure and function of the muffler 410 may be similar or identical to that of the muffler 10 and/or the muffler 310 described above, apart from any exceptions described below and/or shown in the figures. Therefore, similar features will not be described again in detail. The muffler 410 can be manufactured in the same or similar manner as the muffler 10.

A shell 416 of the muffler 410 includes a first outer portion 428, a second outer portion 430 and a central portion 432 disposed therebetween. The second outer portion 430 may be larger (e.g., thicker, longer and/or wider) than the first outer portion 428. Furthermore, FIG. 16 shows the second outer portion 430 having an indentation 439. It will be appreciated that the shapes and/or sizes of any of the first and second outer portions 428, 430 and the central portion 432 may be shaped or sized to suit any given application. That is, the shell 416 can be shaped and/or sized to fit within a given space on a particular vehicle, to achieve a desired the exhaust gas flow rate through the muffler 410 and/or to achieve acoustical properties, for example.

While the mufflers 10, 410 are shown in the figures as including two inlets and two outlets (e.g., for a dual-exhaust system), in some embodiments, the mufflers 10, 410 could be single-exhaust systems (i.e., with only one exhaust inlet into the muffler 10, 410 and only one outlet out of the muffler 10, 410) or quasi-dual-exhaust systems (i.e., with only one exhaust inlet into the muffler 10, 410 with two outlets out of the muffler 10, 410).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of manufacturing a muffler for an exhaust system of an internal combustion engine, the method comprising:

providing a flat, one-piece sheet metal blank having first and second opposing edge portions;

forming the blank into a tubular shell by bending the blank so that the first and second edge portions face each other and fixing the first and second edge portions in contact with each other, the tubular shell defining a central cavity and first and second end cavities, the first and second end cavities having larger cross-sectional areas than a cross-sectional area of the central cavity;

inserting a first subassembly through a first axial end of the tubular shell and positioning the first subassembly in the central cavity, the first subassembly including first and second pipes and a plurality of baffles;

inserting a second subassembly into the first axial end of the tubular shell and fixing the second subassembly in the first end cavity such that a first outlet pipe of the second subassembly is fluidly connected with the first pipe of the first subassembly; and inserting a third subassembly into a second axial end of the tubular shell and fixing the third subassembly in the second end cavity such that a second outlet pipe of the second subassembly is fluidly connected with the second pipe of the first subassembly.

2. The method of claim 1, further comprising inserting a first bushing into a first outlet formed in the tubular shell and into the first outlet pipe.

3. The method of claim 2, further comprising expanding the first bushing with an expansion tool to increase an outer diameter of the first bushing to fixedly couple the bushing to the outlet and the first outlet pipe.

4. The method of claim 1, wherein the third subassembly is inserted into the tubular shell before the first and second subassemblies are inserted into the tubular shell.

5. The method of claim 1, wherein the third subassembly is inserted into the tubular shell after the first and second subassemblies are inserted into the tubular shell.

6. The method of claim 1, wherein the second subassembly includes a first inlet pipe and a first valve assembly configured to control fluid flow through the first inlet pipe, and wherein the third subassembly includes a second inlet pipe and a second valve assembly configured to control fluid flow through the second inlet pipe.

7. The method of claim 6, further comprising inserting bushings into each of the first and second inlet pipes and the first and second outlet pipes and expanding the bushings with an expansion tool to increase outer diameters of the bushings to fixedly couple the bushings to the first and second inlet pipes and the first and second outlet pipes.

8. The method of claim 1, wherein fixing the first and second edge portions of the tubular shell in contact with each other includes welding the first and second edge portions together.

9. The method of claim 1, further comprising fixing first and second end caps to the first and second axial ends of the tubular shell.

10. The method of claim 1, wherein the flat, one-piece sheet metal blank includes a dog-bone shape prior to the blank being formed into the tubular shell.

11. The method of claim 1, further comprising forming a plurality of elongated ridges in the tubular shell, the ridges extending longitudinally parallel to the longitudinal axis and received in notches formed in the plurality of baffles.

12. A muffler receiving exhaust from an engine, the muffler comprising:

a one-piece shell having a first end portion, a second end portion and a central portion disposed therebetween, the shell including a seam that extends parallel to a longitudinal axis of the shell and terminates at a first seam end and at a second seam end that is spaced apart from the first seam end, the first and second end portions defining first and second cavities, at least one of the first and second cavities having a larger cross-sectional area than a cross-sectional area of a central cavity defined by the central portion, the cross-sectional areas of the first, second and central cavities defined by planes that are perpendicular to the longitudinal axis;

a first subassembly disposed within the central portion of the shell and including first and second pipes and a plurality of baffles;

a second subassembly disposed within the first end portion of the shell and including a first outlet pipe fluidly connected with the first pipe of the first subassembly; and a third subassembly disposed within the second end portion of the shell and including a second outlet pipe fluidly connected with the second pipe of the first subassembly.

13. The muffler of claim 12, further comprising first and second end caps attached to the first and second end portions and enclosing the first, second and central cavities.

14. The muffler of claim 12, further comprising first and second bushings extending through the shell and fixedly engaging the first and second outlet pipes.

15. The muffler of claim 14, wherein the first and second bushings directly engage the shell and the first and second outlet pipes.

16. The muffler of claim 12, wherein the second and third subassemblies include first and second inlet pipes that extend through the shell.

17. The muffler of claim 16, further comprising bushings extending through the shell and fixedly engaging the first and second outlet pipes and the first and second inlet pipes.

18. The muffler of claim 12, wherein the first and second end portions have oval-shaped cross sections.

19. The muffler of claim 12, wherein the baffles extend parallel to each other and perpendicular to the longitudinal axis.

20. A muffler receiving exhaust from an engine, the muffler comprising:

a tubular shell defining first and second end cavities and a central cavity disposed therebetween, the first and second end cavities having larger cross-sectional areas that a cross-sectional area of the central cavity, the cross-sectional areas of the cavities defined by planes that are perpendicular to a longitudinal axis of the tubular shell;

a first baffle disposed in the first end cavity and defining a first chamber therein, the first baffle separating the first chamber and the central cavity and including apertures allowing fluid communication between the first chamber and the central cavity;

a second baffle disposed in the second end cavity and defining a second chamber therein, the second baffle separating the second chamber and the central cavity and including apertures allowing fluid communication between the second chamber and the central cavity;

a third baffle disposed in the central cavity and cooperating with the first baffle to define a third chamber therebetween;

a fourth baffle disposed in the central cavity and cooperating with the second baffle to define a fourth chamber therebetween;

a first inlet pipe directing a first portion of the exhaust gas into the first chamber;

a second inlet pipe directing a second portion of the exhaust gas into the second chamber;

a first elongated pipe extending through the first, third and fourth baffles and including an inlet in the fourth chamber, the first elongated pipe directing exhaust gas from the fourth chamber to a first outlet extending through the shell at the first end cavity; and a second elongated pipe extending through the second, third and fourth baffles and including an inlet in the third chamber, the second elongated pipe directing exhaust gas from the third chamber to a second outlet extending through the shell at the second end cavity.

21. The muffler of claim 20, further comprising a fifth baffle disposed in the central cavity between the third and fourth baffles, wherein the third and fifth baffles define a fifth chamber therebetween, and wherein the fourth and fifth baffles define a sixth chamber therebetween.

22. The muffler of claim 21, further comprising a sixth baffle disposed in the first end cavity and cooperating with the first baffle to define the first chamber.

23. The muffler of claim 22, further comprising a seventh baffle disposed in the second end cavity and cooperating with the second baffle to define the second chamber.

24. The muffler of claim 23, further comprising first and second end caps attached to respective axial ends of the shell, wherein the first end cap cooperates with the sixth baffle to define a seventh chamber therebetween, and wherein the second end cap cooperates with the seventh baffle to define an eighth chamber therebetween.

25. The muffler of claim 20, wherein the shell is a one-piece shell including a seam that extends parallel to the longitudinal axis of the shell and terminates at a first seam end and at a second seam end that is spaced apart from the first seam end.

26. The muffler of claim 25, wherein the first and second end cavities have oval-shaped cross sections.

27. The muffler of claim 20, further comprising bushings extending through the shell and fixedly engaging the first and second inlet pipes and the first and second outlets.

28. The muffler of claim 20, wherein the cross-sectional area of one of the first and second end cavities is larger than the cross-sectional area of the other of the first and second cavities.

29. The muffler of claim 20, wherein a cross-sectional shape of one of the first and second end cavities is different than a cross-sectional shape of the other of the first and second cavities.

* * * * *